US006423918B1

(12) United States Patent
King et al.

(10) Patent No.: US 6,423,918 B1
(45) Date of Patent: Jul. 23, 2002

(54) DOME SWITCH

(75) Inventors: Joseph D. King, Hudson, NH (US); John E. McConnell, Ann Arbor, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/532,526

(22) Filed: Mar. 21, 2000

(51) Int. Cl.[7] ..... H01H 5/18
(52) U.S. Cl. ..... 200/406; 200/516
(58) Field of Search ..... 200/512–520, 200/310, 314, 317, 341, 406, 516

(56) References Cited

U.S. PATENT DOCUMENTS

| | | | | | |
|---|---|---|---|---|---|
| 3,911,233 | A | * | 10/1975 | Nakamura et al. | 200/5 R |
| 3,941,964 | A | * | 3/1976 | Yoder | 200/516 |
| 3,982,089 | A | * | 9/1976 | Hyltin | 200/159 B |
| 4,207,448 | A | * | 6/1980 | Furusawa et al. | 200/516 |
| 4,289,942 | A | | 9/1981 | Milianowicz | |
| 4,319,099 | A | | 3/1982 | Asher | |
| 4,349,712 | A | | 9/1982 | Michalski | |
| 4,375,585 | A | * | 3/1983 | Lee | 200/5 A |
| 4,400,596 | A | * | 8/1983 | Fukukura et al. | 200/5 A |
| 4,595,809 | A | | 6/1986 | Pool | |
| 4,892,988 | A | * | 1/1990 | Ishii | 200/516 |
| 4,933,522 | A | | 6/1990 | Celander | |
| 4,978,818 | A | * | 12/1990 | Rothlin | 200/406 |
| 5,118,912 | A | * | 6/1992 | Itabashi | 200/534 |
| 5,399,823 | A | | 3/1995 | McCusker | |
| 5,498,843 | A | * | 3/1996 | Date et al. | 200/6 A |
| 5,595,288 | A | | 1/1997 | Matsui et al. | |
| 5,898,147 | A | | 4/1999 | Domzalski et al. | |
| 5,962,827 | A | * | 10/1999 | Zdanys, Jr. | 200/302.1 |
| 5,986,228 | A | | 11/1999 | Okamoto et al. | |

FOREIGN PATENT DOCUMENTS

| | | | | |
|---|---|---|---|---|
| EP | 347375 | * | 12/1989 | 200/516 |

* cited by examiner

*Primary Examiner*—P. Austin Bradley
*Assistant Examiner*—Lisa N Klaus
(74) *Attorney, Agent, or Firm*—Brooks & Kushman P.C.

(57) ABSTRACT

A dome switch (12) of an electrically operated product (10) includes an electrically conductive dome switch member (30) having a central dimple (36) and a peripheral portion (38) that is secured by two retainers (42) which permit sliding alignment of the dome switch member. A switch actuator (44) of the dome switch (12) has an alignment button (46) received by the dimple (36) of the dome switch member (30) so as to provide sliding of the dome switch member on a circuit board (16) and thereby providing alignment with first and second contacts (18, 20) to provide effective switch closing.

13 Claims, 2 Drawing Sheets

Fig. 1
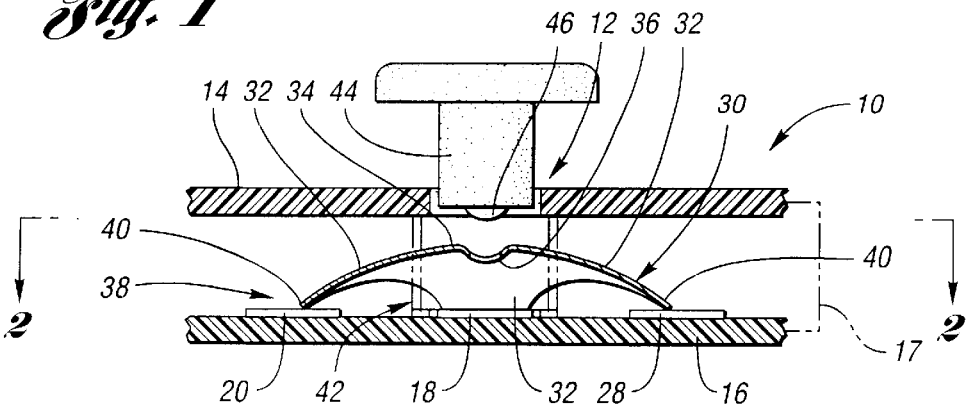
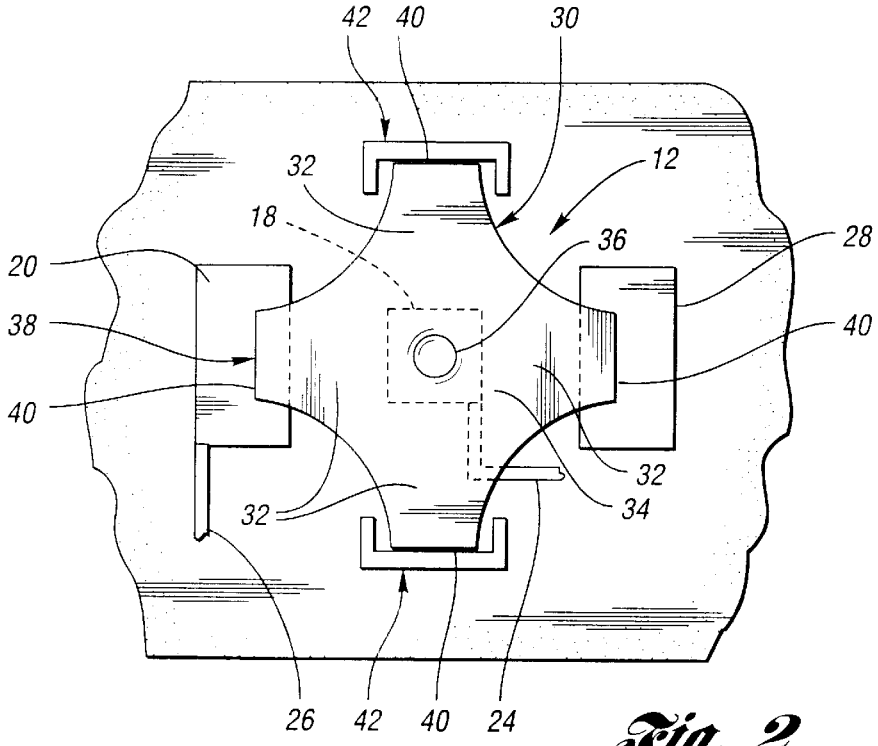
Fig. 2
Fig. 3
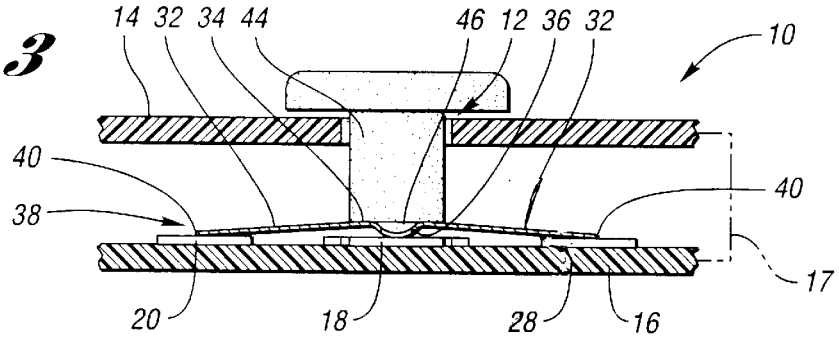

Fig. 4
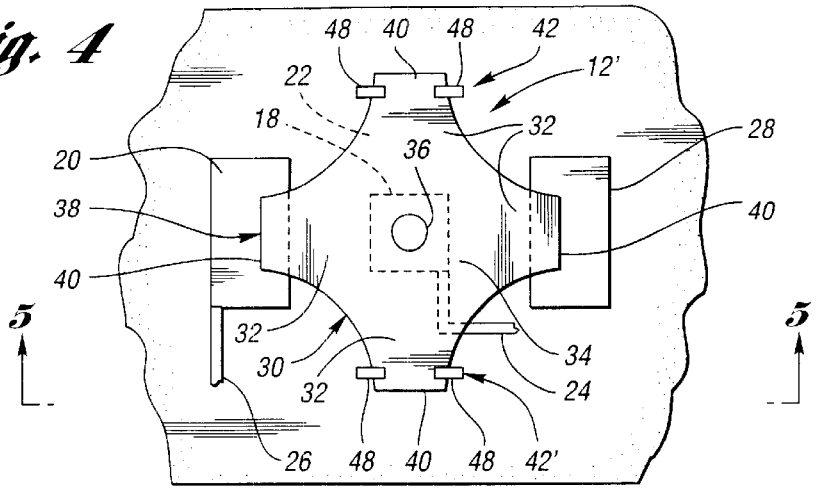
Fig. 5
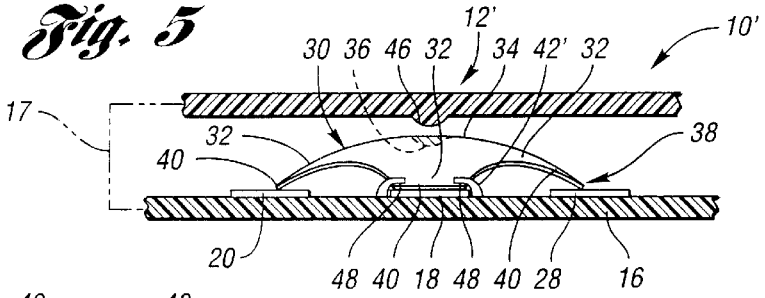
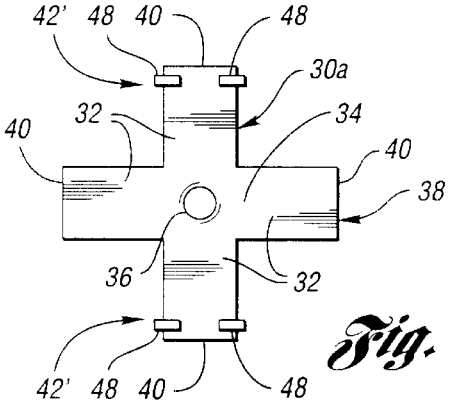
Fig. 6
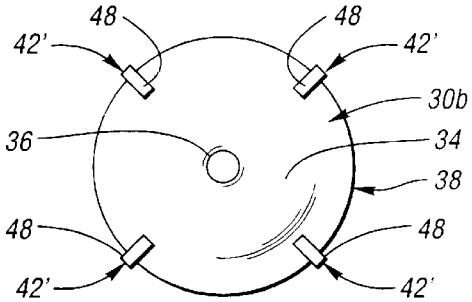
Fig. 7
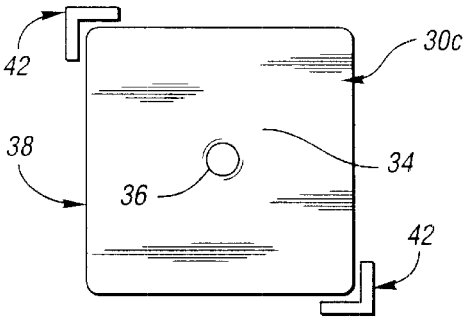
Fig. 8
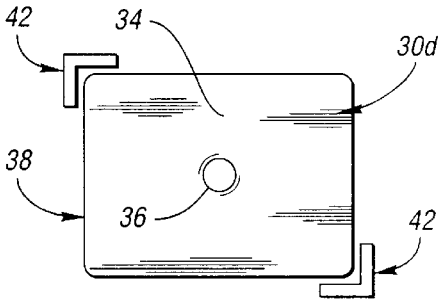
Fig. 9

DOME SWITCH

TECHNICAL FIELD

This invention relates to a dome switch for an electrically operated product.

BACKGROUND ART

Dome switches have previously included an electrically conductive switch member of a domed shape that is mounted on a circuit board of an electrically operated product either by fixed mounting connections or by an adhesive tape. During flattening actuation of the dome switch member to electrically connect two or more contacts on the circuit board, the fixed mounting connections are stretched in a manner than can eventually cause detachment and misalignment with the contacts. Likewise, the adhesive tape can also detach and permit misalignment.

Patents noted during an investigation conducted in connection with this invention include U.S. Pat. No. 4,289,942 Milianowicz; U.S. Pat. No. 4,319,099 Asher; U.S. Pat. No. 4,349,712 Michalski; U.S. Pat. No. 4,595,809 Pool; U.S. Pat. No. 4,933,522 Celander; U.S. Pat. No. 4,978,818 Rothlin; U.S. Pat. No. 5,399,823 McCusker; U.S. Pat. No. 5,595,288 Matsui et al.; U.S. Pat. No. 5,898,147 Domzalski et al; and U.S. Pat. No. 5,986,228 Okamoto et al.

DISCLOSURE OF INVENTION

An object of the present invention is to provide an improved dome switch for an electrically operated product.

In carrying out the above object, the improved dome switch of the invention is utilized with an electrically operated product having a housing and a circuit board mounted by the housing. First and second electrical contacts are mounted on the circuit board in a spaced relationship from each other. An electrically conductive dome switch member of the dome switch has a domed shape with a central portion including a dimple that projects toward but is normally spaced from the first contact on the circuit board. The dome switch member has a peripheral portion that is slidably engaged with the second contact. Two retainers of the dome switch retain the dome switch member on the circuit board but permit sliding alignment therebetween. A switch actuator of the dome switch is actuatable to flatten the dome switch member and move the dimple of its central portion into contact with the first contact and thereby electrically connect the first and second contacts. The switch actuator has an alignment button that is received by the dimple in the central portion of the dome switch member to provide sliding thereof on the circuit board and alignment with the first and second contacts upon its initial flattening actuation by the switch actuator.

The dome switch of the invention as described above thus overcomes unreliable operation of prior art dome switches by allowing the dome switch member to essentially float and self aligned with the contacts on the circuit board during the flattening actuation.

In one construction, the two retainers extend between the circuit board and the housing to retain the dome switch member while permitting sliding thereof on the circuit board to provide the alignment with the first and second contacts.

In another construction, the two retainers extend from the circuit board over the periphery of the dome switch member to retain the dome switch member while permitting sliding thereof on the circuit board to provide alignment with the first and second contacts.

Certain embodiments disclosed each have the periphery of the dome switch member including a pair of first legs retained by the two retainers and also including a second pair of legs that slidably engage the circuit board with one of the second pair of legs providing the slidable engagement of the dome switch member periphery with the second contact.

Different embodiments have the dome switch member provided with a generally star shape which is disclosed as having four legs, a generally cross shape including four legs that slidably engage the circuit board, a generally round shape having a round periphery that slidably engages the circuit board, and a rectangular shape that may be square or elongated.

The objects, features and advantages of the present invention are readily apparent from the following detailed description of the best mode for carrying out the invention when taken in connection with the accompanying drawings.

BRIEF DESCRIPTION OF DRAWINGS

FIG. 1 is a sectional view taken through an electrically operated product having a dome switch constructed in accordance with the invention.

FIG. 2 is a plan view of a dome switch member of the dome switch and is taken along the direction of line 2—2 in FIG. 1.

FIG. 3 is a sectional view similar to FIG. 1 but showing the dome switch member after flattening actuation to close a circuit between two electrical contacts.

FIG. 4 is a plan view of another embodiment of the dome switch which has retainers of a different construction for retaining the dome switch member on a circuit board.

FIG. 5 is a sectional view taken along the direction of line 5—5 in FIG. 4 to further illustrate the alternate construction of the retainers.

FIG. 6 illustrates another construction of the dome switch member which has a cross shape as opposed to the star shape illustrated in FIGS. 2 and 4.

FIG. 7 illustrates the construction of the dome switch member as being round.

FIG. 8 illustrates the construction of the dome switch member as being rectangular with a square shape.

FIG. 9 illustrates the construction of the dome switch member as being rectangular with an elongated shape.

BEST MODE FOR CARRYING OUT THE INVENTION

With reference to FIG. 1 of the drawings, an electrically operated product 10 includes a dome switch 12 that is constructed in accordance with the present invention as is hereinafter more fully described. The electrically operated product 10 includes a housing 14 and a circuit board 16 that is mounted on the housing in any suitable manner as schematically illustrated at 17.

With reference to both FIGS. 1 and 2, the dome switch 12 includes first and second contacts 18 and 20 that are mounted on the circuit board 16 in a spaced relationship and thus normally electrically isolated from each other. The first and second contacts 18 and 20 have traces 24 and 26 that are utilized in circuitry involving the two contacts. The contacts 18 and 20 are actually deposited on the circuit board 16 with the traces 24 and 26 and are often referred to as pods. Furthermore, the contacts 18 and 20 can also be electrically connected to the circuitry by plated through holes in the circuit board 16. In addition, the dome switch 12 also may include another contact 28 that provides symmetry in the dome switch member sliding. This contact 28 as well as two unshown additional contacts may be electrically connected, either by traces or plated through holes, to increase the electrical efficiency and reliability in providing the switching operation.

Dome switch 12 also includes an electrically conductive dome switch member 30 of a domed shape which is illustrated in this embodiment as shown in FIG. 2 as having a generally star shape that includes four legs 32 extending outwardly from a central portion 34. This central portion 34 of the dome switch member 30 has a dimple 36 that projects toward but is normally spaced from the first contact 18 on the circuit board 16. The dome switch member 30 has a periphery collectively indicated by 38 and, as illustrated, defined by the outer ends 40 of the legs 32.

The dome switch 12 also includes two retainers 42 that retain the dome switch member 30 on the circuit board 16 but permit sliding alignment therebetween as is hereinafter more fully described. In the embodiment illustrated, the two retainers 42 cooperate with a first pair of the leg ends 40 to be retained thereby and one of the second pair of leg ends 40 slidably engages the first contact 22 while the other of the second pair of leg ends 40 slidably engages the third contact 28.

The dome switch 12 as shown in FIG. 1 also includes an electrically nonconductive switch actuator 44 that is actuatable by downward movement to flatten the dome switch member 30 and move the dimple 36 of its central portion 34 into contact with the first contact 18 as shown in FIG. 3 to thereby electrically connect the first and second contacts 18 and 20 to provide the switch closing. The switch actuator 44 has an alignment button 46 that is received by the dimple 36 in the central portion 34 of the dome switch member 30 to provide sliding thereof on the circuit board 16 and alignment with the first and second contacts 18 and 20 upon the initial flattening actuation of the switch actuator. A suitable unshown retainer maintains the switch actuator 44 on the housing 14 while permitting its movement for actuating the switch closing.

The retainers 42 as shown in FIGS. 1 and 2 extend between the circuit board 16 and the housing 14 to capture the dome switch member leg ends 40 shown in FIG. 2 in order to retain the dome switch member while permitting the sliding thereof on the circuit board to provide the alignment with the first and second contacts 18 and 20. More specifically, as previously mentioned, the first pair of leg ends 40 are retained by the pair of retainers 42 and one of the second pair of leg ends 40 is slidably engaged with the circuit board 16 at the contact 20 while the other of the second pair of leg ends 40 slidably engages the contact 28. Likewise, the two leg ends 40 held by the retainers 42 may also slidably engage associated unshown contacts on the circuit board 16.

With reference to FIGS. 4 and 5, another embodiment of the dome switch 12' for an electrically operated product 10' includes two retainers 42' that extend from the circuit board 16 over the dome switch member periphery 38 to retain the dome switch member 30 while permitting sliding thereof on the circuit board to provide alignment with the first and second contacts 18 and 20. More specifically, these retainers 42' each include a pair of retainer portions 48 that extend from the circuit board and are formed over the dome switch member leg ends 44 in a loosely retained manner so as to retain the dome switch member 30 while still permitting its sliding to provide the alignment achieved with the dimple and switch actuator alignment button 46. In this embodiment, the switch alignment actuator button 46 is illustrated as being part of a flexible housing 14. Likewise, the switch actuator and its alignment button may take other forms such as part of an integral hinge of the housing, etc.

In addition to the star shape of the dome switch member 30 as illustrated in FIGS. 2 and 4, the dome switch member may also have different constructions. In FIG. 6, the dome switch member 30a as illustrated as having a cross shape whose legs 32 have ends 40 that are secured by the type of retainer 42' shown in FIGS. 4 and 5. Furthermore, the dome switch member 30*b* illustrated in FIG. 7 has a round shape whose round periphery 38 is also secured by retainers 42' of the type shown in FIGS. 4 and 5. Furthermore, both FIGS. 8 and 9 illustrate dome switch member 30*c* and 30*d* that each have a rectangular shape, with the rectangular shape of the FIG. 8 embodiment of the dome switch member 30*c* being square and with the rectangular shape of the FIG. 9 embodiment of the dome switch member 30*d* being elongated, and with both of these rectangular embodiments retained by a pair of retainers 42 at diagonally opposite corners such that one of the other of the corners can function as the corner that engages the active contact on the circuit board.

It should be appreciated with all of the above described embodiments that different types of retainers providing the same function can be utilized and that the different shapes may have the different portions retained by the retainers and the other portions functioning as the active contact portions in accordance with the invention.

Furthermore, while preferred embodiments have been described, it should also be appreciated that other embodiments can be utilized as will be apparent to one skilled in the art in accordance with the following claims.

What is claimed is:

1. A dome switch for an electrically operated product having a housing and a circuit board mounted by the housing, the dome switch comprising:

first and second electrical contacts mounted on the circuit board in a spaced relationship from each other;

an electrically conductive dome switch member having a domed shape with a central portion including a dimple that projects toward but is normally spaced from the first contact on the circuit board, and the dome switch member having a peripheral portion that is slidably engaged with the second contact;

two retainers that extend between the circuit board and the housing to retain the dome switch member while permitting sliding thereof on the circuit board to provide alignment with the first and second contacts; and a switch actuator that is actuatable to flatten the dome switch member and move the dimple of its central portion into contact with the first contact and thereby electrically connect the first and second contacts, and the switch actuator having an alignment button that is received by the dimple in the central portion of the dome switch member to provide sliding thereof on the circuit board and alignment with the first and second contacts upon the initial flattening actuation by the switch actuator.

2. A dome switch as in claim 1 wherein the periphery of the dome switch member includes a first pair of leg ends retained by the two retainers, the periphery of the dome switch also including a second pair of leg ends that slidably engage the circuit board, and one of the second pair of leg ends providing the slidable engagement of the dome switch member periphery with the second contact.

3. A dome switch as in claim 1 wherein the dome switch member has a rectangular shape.

4. A dome switch as in claim 3 wherein the rectangular shape of the dome switch is square.

5. A dome switch as in claim 3 wherein the rectangular shape of the dome switch is elongated.

6. A dome switch for an electrically operated product having a housing and a circuit board mounted by the housing, the dome switch comprising:

first and second electrical contacts mounted on the circuit board in a spaced relationship from each other;

an electrically conductive dome switch member having a domed shape with a central portion including a dimple that projects toward but is normally spaced from the first contact on the circuit board, and the dome switch member having a peripheral portion that is slidably engaged with the second contact;

two retainers that extend from the circuit board over the periphery of the dome switch member to retain the dome switch member while permitting sliding thereof on the circuit board to provide alignment with the first and second contacts; and a switch actuator that is actuatable to flatten the dome switch member and move the dimple of its central portion into contact with the first contact and thereby electrically connect the first and second contacts, and the switch actuator having an alignment button that is received by the dimple in the central portion of the dome switch member to provide sliding thereof on the circuit board and alignment with the first and second contacts upon the initial flattening actuation by the switch actuator.

7. A dome switch as in claim 6 wherein the periphery of the dome switch member includes a first pair of leg ends retained by the two retainers, the periphery of the dome switch also including a second pair of leg ends that slidably engage the circuit board, and one of the second pair of leg ends providing the slidable engagement of the dome switch member periphery with the second contact.

8. A dome switch as in claim 1 or 6 wherein the dome switch member has a generally star shape including legs having ends that slidably engage the circuit board.

9. A dome switch as in claim 8 wherein the star shaped dome switch member has four legs.

10. A dome switch as in claim 6 wherein the dome switch member has a generally cross shape including four legs having ends that slidably engage the circuit board.

11. A dome switch as in claim 6 wherein the dome switch member has a generally round shape having a round periphery that slidably engages the circuit board.

12. A dome switch for an electrically operated product having a housing and a circuit board mounted by the housing, the dome switch comprising:

first and second electrical contacts mounted on the circuit board in a spaced relationship from each other;

an electrically conductive dome switch member having a domed shape with a central portion including a dimple that projects toward but is normally spaced from the first contact on the circuit board, the dome switch member having a peripheral portion having first and second pairs of leg ends slidably engaged with the circuit board, and one of the second pair of leg ends being slidably engaged with the second contact;

a pair of retainers that extend between the circuit board and the housing to retain the first pair of leg ends of the periphery of the dome switch member on the circuit board but permit sliding alignment therebetween; and a switch actuator that is actuatable to flatten the dome switch member and move the dimple of its central portion into contact with the first contact and thereby electrically connect the first and second contacts, and the switch actuator having an alignment button that is received by the dimple in the central portion of the dome switch member to provide sliding thereof on the circuit board and alignment with the first and second contacts upon the initial flattening actuation by the switch actuator.

13. A dome switch for an electrically operated product having a housing and a circuit board mounted by the housing, the dome switch comprising:

first and second electrical contacts mounted on the circuit board in a spaced relationship from each other;

an electrically conductive dome switch member having a domed shape with a central portion including a dimple that projects toward but is normally spaced from the first contact on the circuit board, the dome switch member having a peripheral portion having first and second pairs of leg ends slidably engaged with the circuit board, and one of the second pair of leg ends being slidably engaged with the second contact;

a pair of retainers that extend from the circuit board over the first pair of legs of the periphery of the dome switch member to retain the first pair of leg ends of the periphery of the dome switch member on the circuit board but permit sliding alignment therebetween; and a switch actuator that is actuatable to flatten the dome switch member and move the dimple of its central portion into contact with the first contact and thereby electrically connect the first and second contacts, and the switch actuator having an alignment button that is received by the dimple in the central portion of the dome switch member to provide sliding thereof on the circuit board and alignment with the first and second contacts upon the initial flattening actuation by the switch actuator.

* * * * *